US005779426A

United States Patent [19]

Ishikawa et al.

[11] Patent Number: 5,779,426

[45] Date of Patent: Jul. 14, 1998

[54] LOADING AND UNLOADING UNIT FOR POLISHING APPARATUS

[75] Inventors: Seiji Ishikawa, Yokohama; Takao Mitsukura, Atsugi, both of Japan

[73] Assignee: Ebara Corporation, Tokyo, Japan

[21] Appl. No.: 677,732

[22] Filed: Jul. 8, 1996

[30] Foreign Application Priority Data

Jul. 7, 1995 [JP] Japan ..... 7-196092

[51] Int. Cl.[6] ..... B24B 47/02

[52] U.S. Cl. ..... 414/225; 451/331; 29/90.01; 269/55; 414/736; 414/763

[58] Field of Search ..... 414/222, 225, 414/754, 783, 758, 761, 762, 763, 736, 737, 618, 620; 269/55, 57; 451/11, 331, 332, 334; 427/355, 356, 368; 29/90.01

[56] References Cited

U.S. PATENT DOCUMENTS 4,205,427 6/1980 Koch et al. ..... 414/736 X
4,558,506 12/1985 Kielma ..... 414/736 X
4,915,564 4/1990 Eror et al. ..... 414/736 X
5,135,349 8/1992 Lorenz et al. ..... 414/225 X

FOREIGN PATENT DOCUMENTS 288781 4/1991 Germany ..... 414/736
58-126063 7/1983 Japan .

*Primary Examiner*—Frank E. Werner
*Attorney, Agent, or Firm*—Wenderoth, Lind & Ponack, L.L.P.

[57] ABSTRACT

A polishing apparatus has a turntable and a top ring for gripping a semiconductor wafer to be polished by an abrasive cloth on the turntable. The polishing apparatus incorporates a loading and unloading unit having a supply holder for holding and supplying a semiconductor wafer to be polished to the top ring at a transfer position, and a reception holder for receiving a polished semiconductor wafer from the top ring at the transfer position. The reception holder and the supply holder are mounted on respective opposite ends of a support block which is angularly movable in a vertical plane by a turning mechanism for moving the supply holder and the reception holder alternatively to the transfer position.

26 Claims, 3 Drawing Sheets

LOADING AND UNLOADING UNIT FOR POLISHING APPARATUS

BACKGROUND OF THE INVENTION

1. Field of the Invention:

The present invention relates to a loading and unloading unit for transferring an object to be polished, e.g., a semiconductor wafer, to and from a top ring in a polishing apparatus which polishes the object to a flat mirror finish.

2. Description of the Related Art:

Some polishing apparatuses have a loading and unloading unit for transferring a semiconductor wafer to and from a top ring through supply and reception holders. The supply and reception holders are disposed in respective positions in a horizontal plane, and the top ring can be moved to a transfer position confronting one of the supply and reception holders at a time. When the top ring is moved to the transfer position, a wafer holding mechanism of the top ring is activated or deactivated to receive or supply a semiconductor wafer to the supply or reception holder.

FIGS. 1 through 4 of the accompanying drawings show in plan polishing apparatuses which incorporate conventional loading and unloading units having supply and reception holders A, B, and FIG. 5 of the accompanying drawings shows in side elevation each of the polishing apparatuses shown in FIGS. 1 through 4.

In FIG. 1, a top ring 10 is supported by a carriage 13 which can travel over a turntable 11 on a pair of parallel spaced guide rails 12 positioned on opposite sides of the turntable 11. A loading and unloading unit has a pair of supply and reception holders A, B positioned between the guide rails 12, one on each side of the turntable 11. In FIG. 2, a pair of top rings 10 is supported by a carriage 13 which can travel over a turntable 11 on a pair of parallel spaced guide rails 12 positioned one on opposite sides of the turntable 11. A loading and unloading unit has two pairs of supply and reception holders A, B positioned between the guide rails 12, the supply holders A on one side of the turntable 11 and the reception holders B on the other side of the turntable 11. In FIGS. 1 and 2, the carriage 13 moves along the guide rails 12 for transferring semiconductor wafers between the top ring or rings 10 and the supply and reception holders A, B.

In FIG. 3, a top ring 10 is supported by a swing arm 15 which is angularly movable over a turntable 11 about a support shaft 14. A loading and unloading unit has a pair of supply and reception holders A, B positioned one on respective sides of the turntable 11. In FIG. 4, a pair of top rings 10 is supported by respective swing arms 15 which are angularly movable over a turntable 11 about respective support shafts 14. A loading and unloading unit has two pairs of supply and reception holders A, B positioned at respective sides of the turntable 11. In FIGS. 3 and 4, the swing arm or arms 15 are angularly movable for transferring semiconductor wafers between the top ring or rings 10 and the supply and reception holders A, B.

The conventional loading and unloading units shown in FIGS. 1 through 4 suffer the following problems: Two supply and reception holders A, B need to be associated with one top ring 10, and require their respective installation spaces or areas. Since the top ring or rings 10 move between the supply and reception holders A, B, a mechanism for moving the top ring or rings 10 requires a large installation space or area. Each of the two top rings 10 shown in FIGS. 2 and 4 operates with two supply and reception holders A, B because the two top rings 10 simultaneously supply and receive semiconductor wafers.

The polishing apparatuses shown in FIGS. 1 through 4 are therefore relatively large in size and costly. The cost of an overall semiconductor wafer fabrication system which incorporates the polishing apparatuses is also large because the polishing apparatuses takes up a large space in an expensive clean room.

SUMMARY OF THE INVENTION

It is therefore an object of the present invention to provide a loading and unloading unit for use in a polishing apparatuses, which unit is relatively small in size and still allows the polishing apparatuses to function normally.

According to the present invention, there is provided a loading and unloading unit for use in a polishing apparatuses having a turntable and a top ring for gripping and pressing an object to be polished against the turntable, the unit including supply holder for holding and supplying an object to be polished to the top ring at a transfer position, a reception holder for receiving a polished object from the top ring at the transfer position, the reception holder being connected to the supply holder, and actuating means operatively coupled to the supply holder and the reception holder, for moving the supply holder and the reception holder alternatively to the transfer position. The transfer position remains the same in a horizontal plane, and thence the distance that the top ring moves to the transfer position is relatively small.

The loading and unloading unit may further comprise a support block, the supply holder and the reception holder being mounted on respective opposite ends of the support block and, the actuating means comprising a turning mechanism connected to the support block for angularly moving the support block in a vertical plane. Since the supply holder and the reception holder are mounted on the respective opposite ends of the support block which is angularly movable in the vertical plane, the loading and unloading unit requires a relatively small two-dimensional installation space. As the support block is angularly movable in the vertical plane, the supply and reception holders can be switched around in a small space which depends only on the size of the support block.

The loading and unloading unit may further comprise a lifter mechanism coupled to the supply holder and the reception holder, for vertically moving the supply holder and the reception holder, and may additionally comprise a support block, the supply holder and the reception holder being mounted on respective opposite ends of the support block, and a horizontal shaft connected at one end thereof to the support block, the actuating means comprising a turning mechanism connected to an opposite end of the horizontal shaft for angularly moving the support block in a vertical plane about the horizontal shaft, the horizontal shaft being mounted on an upper end of the lifter mechanism. The supply and reception holders are vertically movable toward and away from the top ring by the lifter mechanism for quick transfer of the object to and from the top ring.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
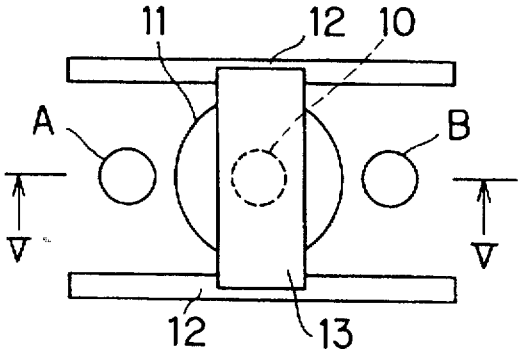
FIG. 1 (PRIOR ART)
FIGS. 1 through 4 are schematic plan views of polishing apparatuses which incorporate conventional loading and unloading units having supply and reception holders.
Figure 2:
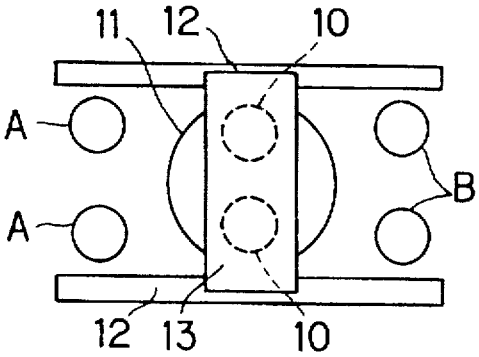
FIG. 2 (PRIOR ART)
Figure 3:
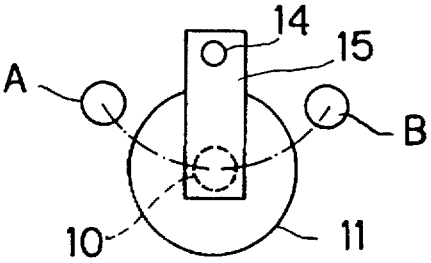
FIG. 3 (PRIOR ART)
Figure 4:
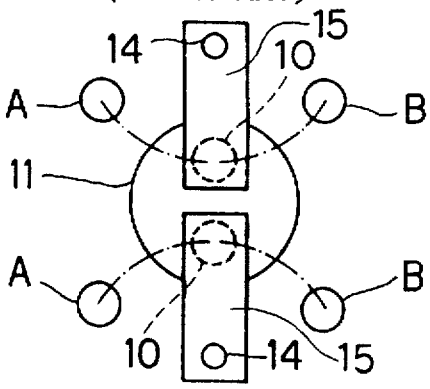
FIG. 4 (PRIOR ART)
Figure 5:
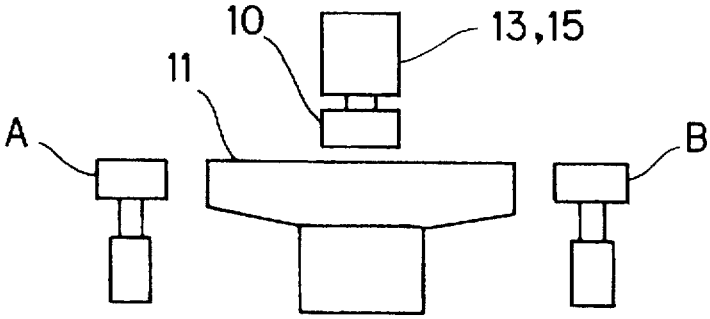
FIG. 5 (PRIOR ART)
FIG. 5 is a side elevational view of each of the polishing apparatuses shown in FIGS. 1 through 4, typically taken along line V—V of FIG. 1.
Figure 6:
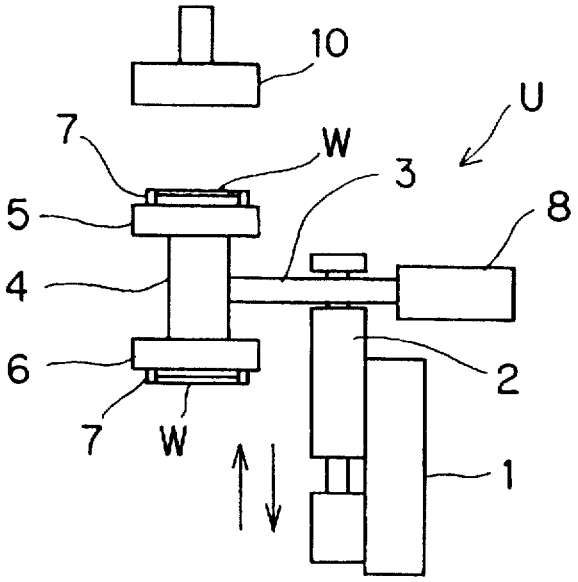
FIG. 6 is a front elevational view of a loading and unloading unit according to the present invention.

As shown in FIG. 6, a loading and unloading unit U according to the present invention generally comprises a base 1 vertically mounted on a foundation such as a floor, a lifter mechanism 2 supported on the base 1, a horizontal shaft 3 rotatably mounted on an upper end of the lifter mechanism 2, a support member such as block 4 mounted on an end of the horizontal shaft 3, and a pair of supply and reception holders 5, 6 mounted on respective opposite ends of the support block 4.

Figure 7:
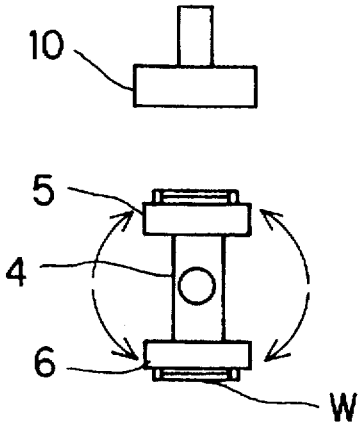
FIG. 7 is a side elevational view of the loading and unloading unit shown in FIG. 6.

Each of the supply and reception holders 5, 6 has a holder mechanism 7 for holding a semiconductor wafer W, i.e., an object to be polished, under a vacuum or with a gripper. A turning mechanism 8 is mounted on the opposite end of the horizontal shaft 3 for turning the support block 4 through 180° in a vertical plane about the axis of the horizontal shaft 3 as shown in FIG. 7. The turning mechanism 8 has an electric motor, a power transmitting mechanism, bearings, and an indexing mechanism (not shown). The support block 4 can be turned 180° by the turning mechanism 8 to bring the support holder 5 into an upper position and the reception holder 6 into a lower position, or to bring the reception holder 6 into an upper position and the support holder 5 into a lower position.

The loading and unloading unit U is incorporated in each of polishing apparatuses shown in FIGS. 8 through 11. FIG. 12 shows in side elevation each of the polishing apparatuses shown in FIGS. 8 through 11.

Figure 8:
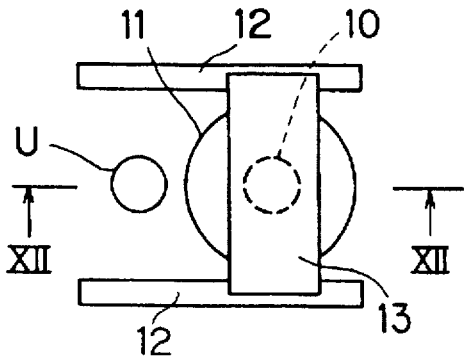
FIGS. 8 through 11 are schematic plan views of polishing apparatuses which incorporate the loading and unloading unit according to the present invention.

In FIG. 8, a top ring 10 is supported by a carriage 13 which can travel over a turntable 11 on a pair of parallel spaced guide rails 12 positioned on opposite sides of the turntable 11. One loading and unloading unit U is positioned between the guide rails 12 on one side of the turntable 11.

Figure 9:
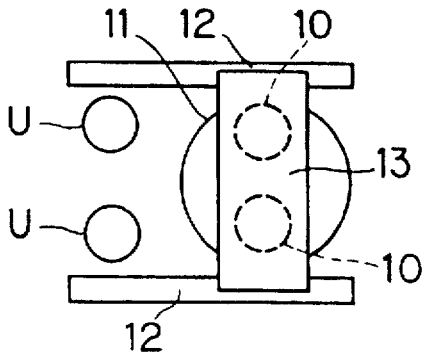

In FIG. 9, a pair of top rings 10 is supported by a carriage 13 which can travel over a turntable 11 on a pair of parallel spaced guide rails 12 positioned on opposite sides of the turntable 11. Two loading and unloading units U are positioned between the guide rails 12 on one side of the turntable 11. The loading and unloading units U operate with the respective top rings 10.

In each of FIGS. 8 and 9, the carriage 13 moves along the guide rails 12 for transferring semiconductor wafers between the top ring or rings 10 and the loading and unloading unit or units U.

Figure 10:
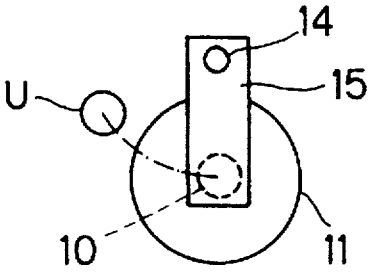

In FIG. 10, a top ring 10 is supported by a swing arm 15 which is angularly movable over a turntable 11 about a support shaft 14. One loading and unloading unit U is positioned on one side of the turntable 11.

Figure 11:
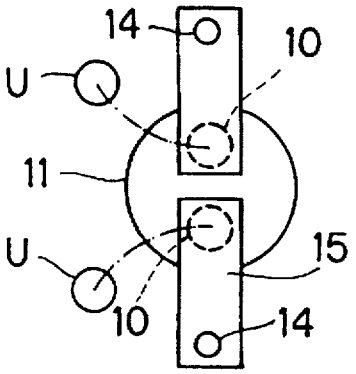
Figure 12:
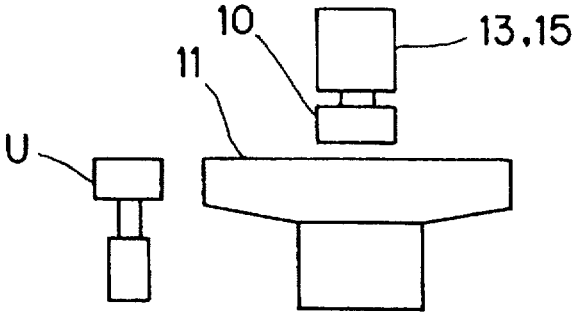
FIG. 12 is a side elevational view of each of the polishing apparatuses shown in FIGS. 8 through 11, typically taken along line XII—XII of FIG. 8.

In FIG. 11, a pair of top rings 10 is supported by respective swing arms 15 which are angularly movable over a turntable 11 about respective support shafts 14. Two loading and unloading units U are positioned on one side of the turntable 11. The loading and unloading units U operate with the respective top rings 10.

In FIGS. 10 and 11, the swing arm or arms 15 are angularly movable for transferring semiconductor wafers between the top ring or rings 10 and the loading and unloading unit or units U.

Each of the loading and unloading units U operates as follows: First, the supply holder 5 holds an unpolished semiconductor wafer W thereon, and the reception holder 6 holds no semiconductor wafer W. For transferring the unpolished semiconductor wafer W to the top ring 10, the turning mechanism 8 is actuated to turn the support block 4, bringing the supply holder 5 into an upper position and the reception holder 6 into a lower position. The carriage 13 (see FIGS. 8 and 9) or the swing arm or arms 15 (see FIGS. 10 and 11) are actuated to move and stop the top ring 10 at a position above the loading and unloading unit U. Then, the lifter mechanism 2 is actuated to lift the horizontal shaft 3 until the supply holder 5 is held against the lower surface of the top ring 10. A holder mechanism of the top ring 10 is now operated to transfer the semiconductor wafer W from the supply holder 5 to the top ring 10.

Thereafter, the support block 4 is lowered by the lifter mechanism 2, and a new unpolished semiconductor wafer W is placed on the supply holder 5 by a robot or a wafer feeder. The turning mechanism 8 is actuated to turn the support block 4, bringing the supply holder 5 with the new unpolished semiconductor wafer W into the lower position and the reception holder 6, which is empty, into the upper position.

The top ring 10 which holds the supplied unpolished semiconductor wafer W is moved to a position above the turntable 11 by the carriage 13 or the swing arm or arms 15. Then, the top ring 10 presses the unpolished semiconductor wafer W against an abrasive cloth on the turntable 11, and rotates the semiconductor wafer W to polish the same. After the semiconductor wafer W is polished, the top ring 10 with the polished semiconductor wafer W is moved to and stopped in the position above the loading and unloading unit U. The lifter mechanism 2 is actuated to position the reception holder 6 near the lower surface of the top ring 10. The holder mechanism of the top ring 10 is operated to transfer the polished semiconductor wafer W from the top ring 10 to the reception holder 6. The reception holder 6 with the polished semiconductor wafer W is lowered by the lifter mechanism 2, and turned 1800° into the lower position by the turning mechanism 8. The polished semiconductor wafer W is then transferred from the reception holder 6 to a robot or wafer feeder, which carries the polished semiconductor wafer W to a next process.

Thereafter, the support block 4 is raised again by the lifter mechanism 2, and the unpolished semiconductor wafer W carried by the supply holder 5 which now is in the upper position is transferred to the top ring 10 in the manner described above. The above loading and unloading process is repeated to process a succession of semiconductor wafers W.

According to the illustrated embodiment of the present invention, as described above, each of the loading and unloading units U has the supply and reception holders 5, 6 and the lifter mechanism 2 and the turning mechanism 8 for moving the supply and reception holders 5, 6 alternatively into a wafer transfer position. Therefore, the loading and unloading unit U offers the following advantages:

The loading and unloading unit U supplies an object to be polished, e.g., an unpolished semiconductor wafer W, to the top ring 10 and receives a polished object polished semiconductor wafer W from the top ring 10, in one position in a horizontal plane. Therefore, the loading and unloading unit U requires a relatively small installation space or area. This is particularly advantageous when there are a plurality of top rings associated with respective loading and unloading units.

Because the installation space or area required by the loading and unloading unit U is relatively small, the polishing apparatuses which incorporates loading and unloading unit or units U can be relatively small in size.

Consequently, the installation space or area taken up by the polishing apparatuses in a clean room can be relatively small.

Although a certain preferred embodiment of the present invention has been shown and described in detail, it should be understood that various changes and modifications may be made therein without departing from the scope of the appended claims.

What is claimed is:

1. A polishing apparatuses for polishing objects, said apparatuses including a turntable, a top ring for holding an object and pressing the object against said turntable to polish the object, and a loading and unloading unit for loading an unpolished object to said top ring and for unloading a polished object from said top ring, said top ring being movable relative to said turntable and said loading and unloading unit to a transfer position, said loading and unloading unit comprising:

a support member having opposite first and second ends, said support member being movable about a horizontal axis such that said opposite first and second ends are angularly movable in a vertical plane;

a supply holder mounted on said first end of said support member for holding an unpolished object and for supplying the unpolished object to said top ring when said top ring is at said transfer position;

a reception holder mounted on said second end of said support block for receiving a polished object from said top ring when said top ring is at said transfer position and for holding the polished object; and means for moving said support member about said horizontal axis and thereby for angularly moving said supply holder and said reception holder with said first and second ends, respectively, in said vertical plane to selectively and alternately position either said supply holder or said reception holder at said transfer position.

2. An apparatuses as claimed in claim 1, wherein said supply holder is mounted at a fixed position relative to said first end of said support member, and said reception holder is mounted at a fixed position relative to said second end of said support member.

3. An apparatuses as claimed in claim 1, wherein said means for moving comprises a horizontal shaft fixed to said support member and defining said horizontal axis.

4. An apparatuses as claimed in claim 3, wherein said means for moving further comprises a turning mechanism connected to said horizontal shaft for rotating said horizontal shaft and said support member about said horizontal axis.

5. An apparatuses as claimed in claim 4, further comprising a base supporting said horizontal shaft.

6. An apparatuses as claimed in claim 5, further comprising a lifter mechanism for vertically moving said horizontal shaft and said support member relative to said base.

7. An apparatuses as claimed in claim 6, wherein said lifter mechanism rotatably supports said horizontal shaft.

8. An apparatuses as claimed in claim 1, wherein said means for moving comprises a turning mechanism connected to said support member for rotating said support member about said horizontal axis.

9. An apparatuses as claimed in claim 8, further comprising a base supporting said support member.

10. An apparatuses as claimed in claim 9, further comprising a lifter mechanism for vertically moving said support member relative to said base.

11. An apparatuses as claimed in claim 1, further comprising a base supporting said support member.

12. An apparatuses as claimed in claim 11, further comprising a lifter mechanism for vertically moving said support member relative to said base.

13. An apparatuses as claimed in claim 1, further comprising a lifter mechanism for vertically moving said support member.

14. A loading and unloading unit, for use in a polishing apparatuses for polishing objects and including a turntable and a top ring for holding an object and pressing the object against the turntable and the top ring being movable relative to the turntable to a transfer position, said loading and unloading unit comprising:

a support member having opposite first and second ends, said support member being mountable at a position adjacent the polishing apparatuses for movement about a horizontal axis such that said opposite first and second ends are angularly movable in a vertical plane;

a supply holder mounted on said first end of said support member for holding an unpolished object and for supplying the unpolished object to the top ring when the top ring is in the transfer position;

a reception holder mounted on said second end of said support member for receiving a polished object from the top ring when the top ring is in the transfer position and for holding the polished object; and means for moving said support member about said horizontal axis and thereby for angularly moving said supply holder and said reception holder with said first and second ends, respectively, in said vertical plane to selectively and alternately position either said supply holder or said reception holder at the transfer position.

15. A unit as claimed in claim 14, wherein said supply holder is mounted at a fixed position relative to said first end of said support member, and said reception holder is mounted at a fixed position relative to said second end of said support member.

16. A unit as claimed in claim 14, wherein said means for moving comprises a horizontal shaft fixed to said support member and defining said horizontal axis.

17. A unit as claimed in claim 16, wherein said means for moving further comprises a turning mechanism connected to said horizontal shaft for rotating said horizontal shaft and said support member about said horizontal axis.

18. A unit as claimed in claim 17, further comprising a base supporting said horizontal shaft.

19. A unit as claimed in claim 18, further comprising a lifter mechanism for vertically moving said horizontal shaft and said support member relative to said base.

20. A unit as claimed in claim 19, wherein said lifter mechanism rotatably supports said horizontal shaft.

21. A unit as claimed in claim 14, wherein said means for moving comprises a turning mechanism connected to said support member for rotating said support member about said horizontal axis.

22. A unit as claimed in claim 21, further comprising a base supporting said support member.

23. A unit as claimed in claim 22, further comprising a lifter mechanism for vertically moving said support member relative to said base.

24. A unit as claimed in claim 14, further comprising a base supporting said support member.

25. A unit as claimed in claim 24, further comprising a lifter mechanism for vertically moving said support member relative to said base.

26. A unit as claimed in claim 14, further comprising a lifter mechanism for vertically moving said support member.

* * * * *